United States Patent [19]

Gerbaud et al.

[11] Patent Number: 4,652,330

[45] Date of Patent: Mar. 24, 1987

[54] LABEL SELECTOR FOR FRANKING MACHINES

[75] Inventors: Claude Gerbaud, Massy; Claude Tétard, Maurepas, both of France

[73] Assignee: SMH Alcatel, Paris, France

[21] Appl. No.: 855,259

[22] Filed: Apr. 24, 1986

[30] Foreign Application Priority Data

Apr. 24, 1985 [FR] France ..... 85 06265

[51] Int. Cl.[4] ..... B65H 26/00

[52] U.S. Cl. ..... 156/361; 101/91; 101/92; 101/228; 156/350; 156/387

[58] Field of Search ..... 101/53, 91, 92, 228; 156/277, 353, 354, 442, 350, 361, 387, 384

[56] References Cited

U.S. PATENT DOCUMENTS

| | | | |
|---|---|---|---|
| 2,001,287 | 5/1935 | Ryan | 101/301 |
| 3,062,133 | 10/1962 | Lundquist et al. | 101/92 |
| 3,083,637 | 3/1963 | Ritzerfeld et al. | 101/91 |
| 3,242,854 | 3/1966 | Ritzerfeld et al. | 101/91 |
| 3,245,367 | 4/1966 | Ritzerfeld et al. | 101/91 |
| 4,007,359 | 2/1977 | Ford | 235/101 |

FOREIGN PATENT DOCUMENTS 476354 9/1969 Switzerland .

*Primary Examiner*—David Simmons
*Assistant Examiner*—Jeff H. Aftergut
*Attorney, Agent, or Firm*—Sughrue, Mion, Zinn, Macpeak & Seas

[57] ABSTRACT

A franking machine has a control lever (7) which is operable between a first position and a second position to cause a slogan to be printed or not to be printed respectively. When said franking machine is being fed with labels, the label selector selects a short label or a long label depending on whether the label is to receive a slogan. The label selector comprises an emitter (E) and a receiver (R) which are mounted in an opto-electronic detector head (41) at a distance from said lever (7) and which are coupled to each other by means of a mirror (42) mounted on the lever (7), but only when the lever is in one of its two specified positions.

5 Claims, 1 Drawing Figure

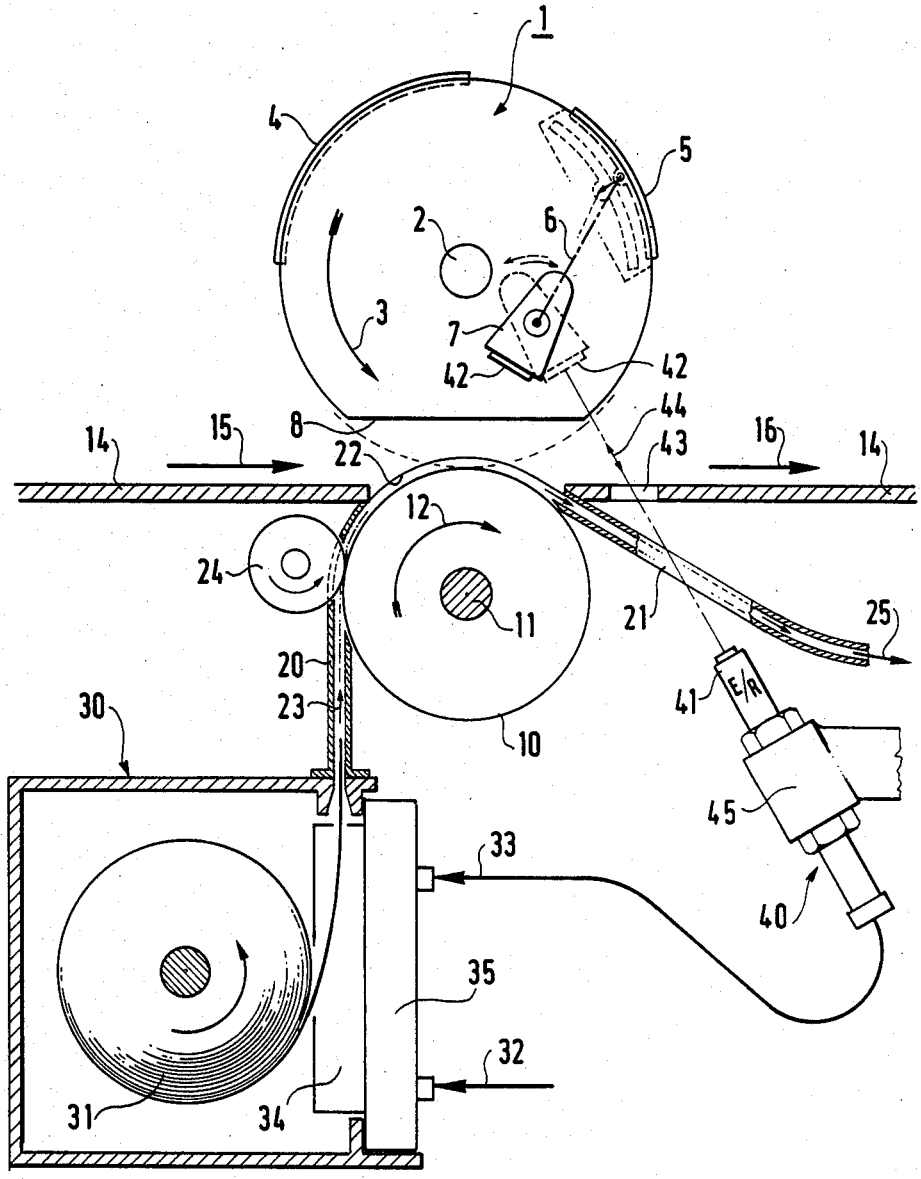
1
4
5
2
6
3
7
42
42
44
14
15
8
22
43
16
14
12
24
11
21
25
20
23
41
E/R
30
10
45
33
40
35
32
31
34

LABEL SELECTOR FOR FRANKING MACHINES

The present invention relates in general to franking machines. It relates more particularly to a label selector for selectively feeding a franking machine with short or long labels depending on whether the franking is to be limited to postage rates only, or whether the postage rate is to be accompanied by additional unchanging information, such as an advertizing slogan.

BACKGROUND OF THE INVENTION

Present franking machines include, in known manner, first means for printing a postage rate and second, retractable means for printing unchanging information, such as an advertizing slogan, for example, with said first and second means being comprised within a rotary drum print head. The head is also fitted with a control lever linked to said second print means for retracting them or for extending them. The control lever is mounted at the end of the head so as to be accessible. It is manually operable between a first position in which said second means are retracted and the print head only prints postage data, and a second position in which said second print means are not retracted and in which the print head prints both postage data and the advertizing slogan, one after the other.

Such one-part or two-part printing is performed either directly onto envelopes or else onto labels which are long or short depending on the amount of printing they are to receive. After printing, the labels are stuck onto parcels and other packets. In such franking machines, the print head and an associated backing roll or platen are mounted so that the items to be printed on pass between them, i.e. so that said labels or envelopes driven by a transport mechanism pass between them. The labels are delivered by an automatic label dispenser provided in the franking machine.

In automatic label dispensers, labels are advantageously taken on request from a continuous franking label tape stock which is cut to the desired label length. The tape is driven intermittently in response to an externally applied control signal to cut off a first or a second length of tape depending on whether a further externally applied control signal is requesting short label selection or long label selection. With such franking machines, the operator who positions the one-part or two-part printing control lever for the print head must also ensure that the appropriate label selection control signal is applied, and must consequently also position a control lever provided for this purpose.

Preferred implementations of the present invention provide reliable means for selecting short or long labels from a label dispenser in a franking machine, and for preventing the franking machine from being supplied with short labels when it is performing two-part printing, since a portion of the two-part printing would otherwise be applied to the backing roll.

SUMMARY OF THE INVENTION

The present invention provides a label selector for selectively feeding a franking machine with short or long labels from a label dispenser, said franking machine having a print head including first means for printing franking information and second means for optionally printing additional information in the form of a slogan, said second means being controlled by a slogan lever which is operable to occupy a first position in which it causes the slogan not to be printed and a second position in which it causes the slogan to be printed, said label selector including the improvement of an emitter and a receiver which are mounted relative to said slogan lever in such a manner as to be coupled to each other in one only of said first and second positions of said lever, thereby constituting a slogan lever position detector, said detector being connected to said label dispenser to control selection of the length of label which said dispenser supplies to the franking machine.

Preferably, said emitter and receiver are both mounted at a distance from the lever in a single optoelectronic head, and said lever bears a mirror for coupling them together in said selected position of the lever.

In particular, said position of the lever is advantageously the first position for which said second means associated with printing the slogan are retracted to prevent printing thereof.

BRIEF DESCRIPTION OF THE DRAWING

An embodiment of the invention is described by way of example with reference to the sole FIGURE of the accompanying drawing. This FIGURE is a diagrammatic section through a franking machine fitted with a label selector in accordance with the invention.

MORE DETAILED DESCRIPTION

The franking machine is of conventional type, and is represented diagrammatically in the FIGURE by a print drum 1 fixed to a shaft 2 for rotating the drum in the direction of an arrow 3. The drum constitutes a part of the machine's print head. It bears a first engraved printing plate for postal franking purposes, this first plate 4 is curved and is fixed to the periphery of the drum. Means are provided for printing the amount franked, usually in conjunction with the date. These means may be of the type comprising print wheels inside the drum and adjustable in position, or else they may be of the type comprising a printing ink jet (not shown) operated synchronously with the drum and associated therewith for printing through suitable windows.

The print drum 1 also carries a second printing plate 5 which is retractably mounted on its periphery. This second, or "slogan" printing plate 5 is intended for optionally printing fixed additional information, e.g. an advertizing slogan. The slogan plate 5 is connected to a control lever 7 by a set of hinged linkages symbolized by a dot-dashed line 6. The control lever 7 (or slogan lever) is mounted at the end of the print drum 1 and is operable by the user to take up a first position (shown in dashed lines) in which the slogan plate 5 is retracted (also shown in dashed lines), or a second position (shown in solid lines) in which the slogan plate 5 is in its non-retracted or print position (also shown in solid lines).

A flat 8 on the print drum defines a rest position for the drum and also serves for recognizing said rest position. The slogan lever 7 is put into one or other of its first and second control positions when the drum is in its rest position in order to select or deselect the slogan plate.

Advantageously, although not shown, guide means of the type having a resiliently biased end ball are provided on the rear face of the lever 7, and two cylindrical molds interconnected by a groove in the form of an arc of a circle are provided in the end space of the drum in order to make the first and second positions of the lever stable positions.

A print backing roll 10 rotated about its axis 11 in the direction of arrow 12 is mounted beneath the print drum 1. The backing roll 10, like the drum 1, is supported by the frame of the machine (not shown). In practice, the backing roll 10 is resiliently urged to co-operate effectively with the print drum during printing. When the print head is in its rest position, the flat 8 in the drum is opposite the backing roll and thereby leaves a relatively large gap between the drum and the roll.

In the franking machine, an envelope printing table 14 defines a guidance and drive path for envelopes between the print head 1 and the print backing roll 10. The envelopes are driven along arrow 15 between the drum and the backing roll. Once they have been printed on, they are removed in the direction of arrow 16. The same franking machine includes an inlet passage 20 for guiding and driving labels between the print drum and the backing roll, and an outlet passage 21 for delivering printed labels.

A part 22 including a window which is open towards the print drum is provided between said inlet and outlet passages, and guides the labels by their edges only while they are being printed on. The labels are driven in the direction of arrow 23 along the inlet passage 20. A wheel 24 shown pressing against the backing roll serves to drive them thereagainst. Once the labels have been printed on, they are ejected in the direction of arrow 25.

The inlet passage 20 is constituted by the outlet from an automatic label dispenser 30 of a generally known type, which in practice is fitted in the franking machine. This dispenser 30 is not described in detail below, and serves to feed the franking machine with short or long labels on request by suitably cutting up a continuous reel of franking tape 31. To this end, the dispenser includes a first external control signal input 32 for receiving a label-dispensing control signal, and a second external control signal input 33 for receiving a short or long label select signal. A mechanism 34 is responsive to these two control signals to drive the tape along a first or a second predetermined length in order to dispense a suitably-sized label from said tape.

In accordance with the present invention, the franking machine is further equipped with a label selector 40 which has an output connected to the short or long label select input 33. The selector 40 is constituted by a detector for detecting one of the two possible positions of the slogan lever 7 while the drum 1 is in its rest position. It includes an emitter E and a receiver R mounted relative to the lever 7 in such a manner as to be coupled to each other only when the level is in said one position.

In the FIGURE, the emitter and the receiver are mounted at a distance from the lever in a single opto-electronic emitter-receiver head 41 incorporating or connected to circuits for amplifying and processing the electric signal at the output from the receiver. The lever bears a reflecting mirror 42 which receives light from the emitter and which returns it to the receiver when the lever 7 is in said first position, i.e. the position in which the slogan printing plate 5 is retracted and incapable of printing.

The detection head 41 is mounted beneath the envelope printing table 14 which has a window 43 provided therethrough, which window is transparent to light rays and is located on the path of radiation emitted by the head and reflected back by the mirror. This path is referenced 44. In the arrangement shown in the FIGURE, the path is substantially perpendicular to the mirror when the lever is in said first position. A support 45 fixed to the head 41 ensures that the head 41 is fixed to the frame of the machine.

When the lever 7 is in said first, non-printing position for the slogan, the coupling between the emitter and the receiver provided by the mirror 42 causes the head to deliver a signal to the input 33 representative of a short label being selected. However, when the lever 7 is in its slogan-printing position (as shown in solid lines) the signal delivered by the head is representative of no coupling between the emitter and the receiver, and this signal as applied to the input 33 constitutes the signal for selecting a long label. Naturally, the label dispenser pays attention to the input signal 33 for selecting short or long labels only when the print head 1 is in its rest position and when a label dispensing control signal is applied to its input 32. To this end, the label dispenser 30 is provided with a circuit 35 under the control of the label dispensing signal present on the input 32 for sampling or detecting the level of the signal applied by the head 41 to the input 32, and for providing the appropriate control signals to said means 34 for driving the tape.

In the embodiment described, the label selector is mounted to remotely sense when the slogan lever 7 is in its non-printing position, which corresponds to the dispenser being required to dispense a short label. It is particularly advantageous for this position of the lever to be the position which is detected. With this specific configuration, and in the event of a head failure, the signal applied to the input 33 corresponds to a long label being selected, even when the lever is in its first position for retracting the slogan printing plate. This merely leads to a short message being printed on a long label. In contrast, if the opposite configuration is selected, and in the event of a head failure, a long message is printed on a short label, with a part of the long message being printed, as a result, on the backing roll.

The present invention has been described with reference to the particular example shown in the drawing. Naturally the means specific to the print head and to the label dispenser which have been shown in general terms above cannot, per se, constitute a limitation on the scope of the invention. Similarly, the advantageous disposition of the emitter and the receiver in a single opto-electronic head cannot constitute a limitation on the way in which the position of the slogan lever is, in fact, remotely sensed.

We claim:

1. A label selector for selectively feeding a franking machine with short or long labels from a label dispenser, said franking machine having a print head including first means for printing franking information and second means for optionally printing additional information in the form of a slogan, said second means being controlled by a slogan lever which is operable to occupy a first position in which it causes the slogan not to be printed and a second position in which it causes the slogan to be printed, said label selector including the improvement of an emitter and a receiver which are mounted relative to said slogan lever in such a manner as to be coupled to each other in one only of said first and second position detector, said detector being connected to said label dispenser to control selection of the length of label which said dispenser supplies to the franking machine.

2. A label selector according to claim 1, wherein said emitter and receiver are coupled to each other when said slogan lever is in said first position.

3. A label selector according to claim 1, wherein said emitter and said receiver are both mounted at a distance from said slogan lever, and wherein said slogan lever is fitted with means for coupling them together in said one of said lever positions.

4. A label selector according to claim 3, wherein said emitter and said receiver are opto-electronic devices and are mounted in a single emitter-receiver head, and wherein said means providing coupling therebetween is constituted by a mirror mounted on said lever.

5. A label selector according to claim 1, wherein it is connected to said label dispenser via a circuit for detecting the level of the signal applied thereto under the control of a signal requesting that a label be dispensed.

* * * * *